US005347959A

United States Patent [19]

Slama et al.

[11] Patent Number: 5,347,959

[45] Date of Patent: Sep. 20, 1994

[54] STEAM GENERATOR SUPPLIED WITH SECONDARY WATER FROM THE BOTTOM PART

[75] Inventors: Georges Slama, Saint-Maur; Thierry Daffos, Maurecourt; Henri Ayme, Suresnes; Yves Pascal, Nanterre; Bernard Cornu, Les Clayes Bas; Philippe Denis, Puteaux, all of France

[73] Assignee: Framatome, France

[21] Appl. No.: 18,242

[22] Filed: Feb. 16, 1993

[30] Foreign Application Priority Data

Feb. 17, 1992 [FR] France ..... 92 01765
Mar. 5, 1992 [FR] France ..... 92 02650

[51] Int. Cl.[5] ..... F22B 1/02
[52] U.S. Cl. ..... 122/32; 122/457 R
[58] Field of Search ..... 122/33, 32, 451, 504

[56] References Cited

U.S. PATENT DOCUMENTS 5,110,538 5/1992 Pascal et al. ..... 122/32 X

FOREIGN PATENT DOCUMENTS 2161593 7/1973 France .
2212024 7/1974 France .
2244129 4/1975 France .
2387417 11/1978 France .
2394750 1/1979 France .

*Primary Examiner*—Edward G. Favors
*Attorney, Agent, or Firm*—Pollock, Vande Sande & Priddy

[57] ABSTRACT

The secondary water supply for a steam generator is provided by a toroidal or semitoroidal collector (38) placed in the bottom of the annular recirculation space (32) of the generator, in a larger diameter part (36) of the outer envelope. The collector (38) has holes (40) ensuring a vertical mean flow of the secondary water into the annular space (32). The cross-section of the holes is chosen in such a way as to trap in the collector the migrating bodies or members from the secondary water circuit and which could damage the steam generator tubes. At least one access orifice makes it possible to extract these migrating bodies from the collector during maintenance operations.

16 Claims, 5 Drawing Sheets

STEAM GENERATOR SUPPLIED WITH SECONDARY WATER FROM THE BOTTOM PART

FIELD OF THE INVENTION

The present invention relates to a steam generator for use in a pressurized water nuclear reactor and comprises a secondary water supply directly in the bottom part of the generator.

BACKGROUND OF THE INVENTION

As is more particularly illustrated by FR-A-2,333,200, a steam generator equipping a nuclear power station conventionally comprises a vertically axed, outer envelope, whose internal space is subdivided into two portions in the heightwise direction by a horizontal plate known as a tube plate. The ends of the tubes of an inverted U-shaped tube bundle are fixed to the tube plate and issue below the latter respectively into an admission collector and into a discharge collector for the water circulating in the primary circuit of the reactor, known as primary water. The water circulating in the secondary circuit of the reactor, known as secondary water or feed water, is injected into the part of the steam generator positioned above the tube plate by a torodial or semitorodial main supply collector. This supply collector is conventionally placed above an annular recirculation space formed between the outer envelope and an inner envelope covering the tube bundle and whose lower edge is spaced from the tube plate.

In steam generators of this type, the installation of the secondary water supply collector takes place above the annular recirculation space, but below the level of the water contained in the outer envelope. However, in the absence of special precautions, a stoppage or reduction in the flow of water in the reactor secondary circuit could lead to an emptying of the supply collector causing pressure jumps and surges during the restarting of the pumps installed in the secondary circuit.

As illustrated by FR-A-2,333,200, this problem has been solved by equipping the supply collector with inverted J-shaped tubes by which the collector issues above the annular recirculation space. However, this procedure suffers from the disadvantage of making the manufacture of the steam generator more complicated and therefore increasing the length of the manufacturing process.

Moreover and as is more particularly illustrated by U.S. Pat. No. 3,804,069, 3,896,770 and 3,916,843, consideration has also been given to supplying the secondary water to the steam generator by directly connecting a secondary water admission tube to a lower part of the inner envelope, so as to cause the secondary water to enter directly at the base of cold branches of the tubes of the bundle. More specifically, deflectors positioned facing the admission tube and around the cold branches then form a device for preheating the secondary water flowing between the tubes.

If the aforementioned solution makes it possible to eliminate any pressure jump or surge risk following a stoppage of the water flow in the secondary circuit, it still has the disadvantage of subjecting the lower parts of the cold branches of tubes to significant transverse flows, while preventing controlled distribution of the secondary water flow over the steam generator cross-section.

Moreover, if the migrating bodies or members such as filler rods, screws, bolts, etc., inadvertently introduced into the secondary circuits during manufacture enter the steam generator through the secondary water admission tube, they can become wedged between and therefore damage the tubes of the bundle.

SUMMARY OF THE INVENTION

The invention specifically relates to a steam generator with its main supply collector located in the bottom part of the apparatus, which in simple manner makes it possible to avoid any risk of pressure jumps or surges in the secondary circuit, while permitting effective mixing or homogenization of the secondary water entering the generator before it reaches the bottom part of the tubes, controlled distribution of the secondary water flow and trapping of migrating bodies liable to penetrate the tube bundle via the secondary water circuit and damage the steam generator tubes.

According to the invention this result is obtained by means of a steam generator comprising a vertically axed outer envelope, a horizontal tube plate tightly fixed to the interior of the outer envelope, a bundle of inverted U-tubes, each having two ends fixed to the tube plate and issuing below the latter, respectively into an admission collector and into a discharge collector for the primary fluid, an inner envelope covering the tube bundle and having a lower edge spaced from the tube plate and forming with the outer envelope an annular recirculation space, secondary water supply means incorporating a main supply collector and secondary steam extraction means through upper parts of the inner and outer envelopes, characterized in that the main supply collector is placed in the bottom part of the annular recirculation space and has holes ensuring a substantially vertical mean flow of the secondary water into the annular space, the holes having a maximum size smaller than the minimum distance separating the tubes.

Thus, migrating bodies which may enter the steam generator by the secondary Water supply collector do not become jammed between the tubes of the bundle.

In a variant of the invention, the main supply collector is partly defined by the inner envelope.

Depending on the particular case, the holes in the supply collector may issue downwards, upwards, or both upwards and downwards.

To facilitate the installation of the recirculation collector in the bottom part of the annular supply space, part of the outer envelope can advantageously be constructed with a larger diameter.

Preferably, the supply collector has at least one access opening, normally closed by a preferably captive plug, positioned facing an inspection opening formed in the outer envelope and normally closed by a hatch. This feature makes it possible to periodically inspect the interior of the supply collector and extract therefrom any migrating bodies which might be trapped there.

Depending on the particular case, the supply collector be toroidal or semitoroidal and it advantageously has a substantially rectangular cross-section. However, it could also have a different cross-section, e.g., circular or square, without passing outside the scope of the invention.

DESCRIPTION OF THE PREFERRED EMBODIMENTS

Figure 1:
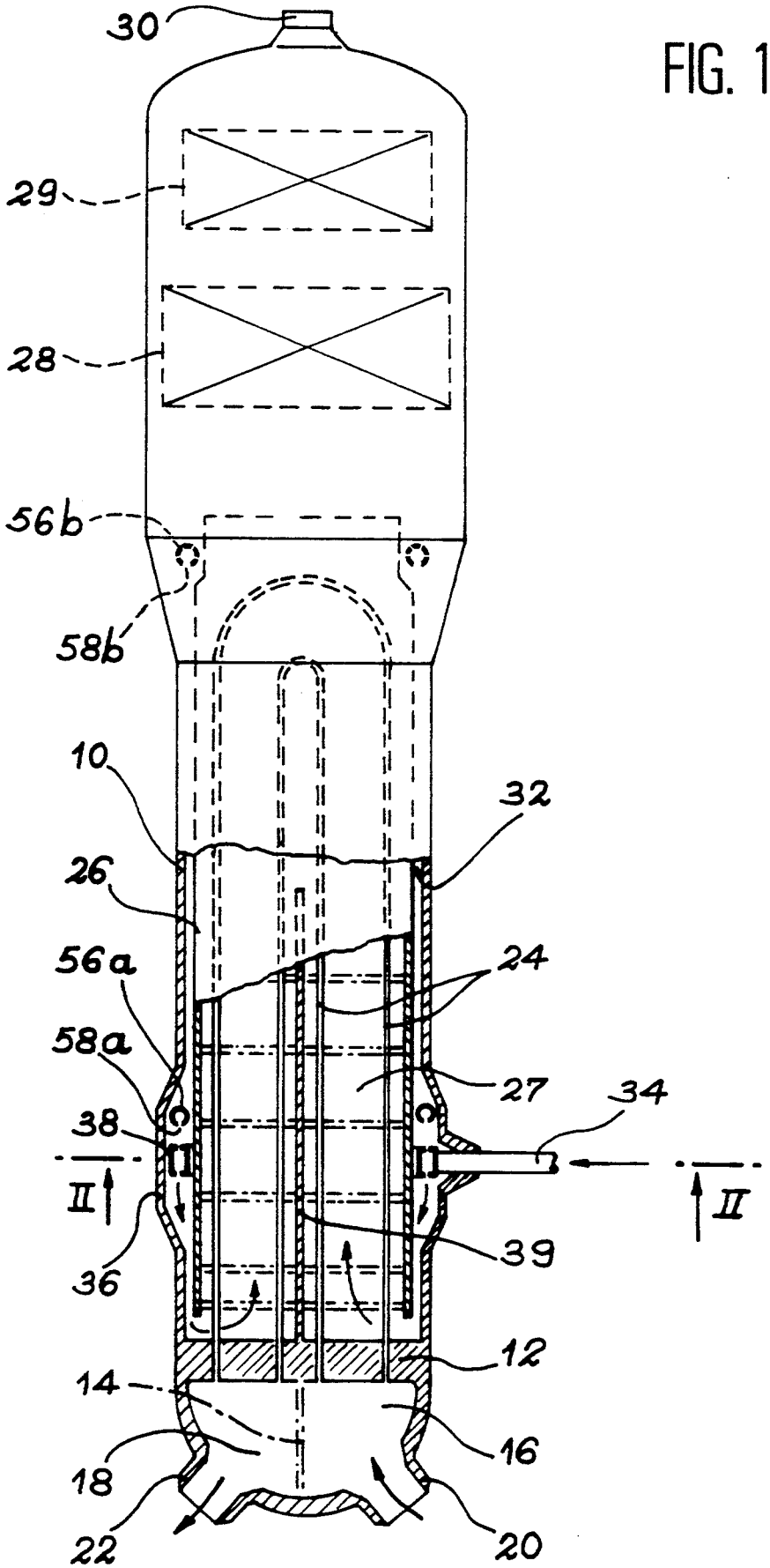
FIG. 1 is a side view schematically illustrating in part vertical section a steam generator according to the invention.

FIG. 1 shows the vertically axed, external revolution envelope 10 of a steam generator for the transfer of heat between the primary water circuit and the water-steam secondary circuit of a pressurized water nuclear reactor. The envelope 10 defines a closed inner space, which is subdivided into a primary lower zone and a secondary upper zone by a horizontal tube plate 12 tightly connected to the envelope 10.

A vertical partition 14 subdivides the primary lower zone, normally referred to as the water box, into an admission collector 16 and a discharge collector 18 for the water circulating in the reactor primary circuit. Tubes 20,22 welded to the outer envelope 10 of the steam generator respectively connect the collectors 16,18 to the primary circuit.

A bundle of inverted U-tubes 24 is tightly connected to the tube plate 12, in the upper secondary zone defined by the latter, so that the two ends of each of the tubes respectively issue into the admission collector 16 and the discharge collector 18.

The bundle of tubes 24 is surrounded and covered by an inner envelope 26 arranged coaxially in the outer envelope 10. The upper horizontal wall of the inner envelope 26 is traversed by watersteam separators 28 and dryers 29, which link the space 27 formed within the envelope 26 with a steam discharge tube 30 located at the top of the outer envelope 10. The lower edge of the inner envelope 26 is placed at a given distance above the tube plate 12, so as to form a passage between an annular recirculation space 32 defined between the envelopes 10,26 and the space 27 within the inner envelope 26.

According to the invention, the secondary water is introduced into a bottom part of the annular recirculation space 32 by a supply tube 34, which tightly traverses an advantageously larger diameter part 36 of the outer envelope 10 and issues into the space 32 by a supply collector 38.

The structure of the supply collector 38 will now be described in greater detail relative to FIGS. 2 to 4.

Depending on the steam generator type involved, the supply collector 38 may have a toroidal or semitoroidal shape, centered on the vertical axis of the outer envelope 10. More specifically, when the steam generator is of the evaporator tube type, i.e., has no partition plate between the hot and cold branches of the tubes 24, the secondary water supply takes place over the entire periphery of the annular space 32, which means that the collector 38 is toroidal.

Figure 2:
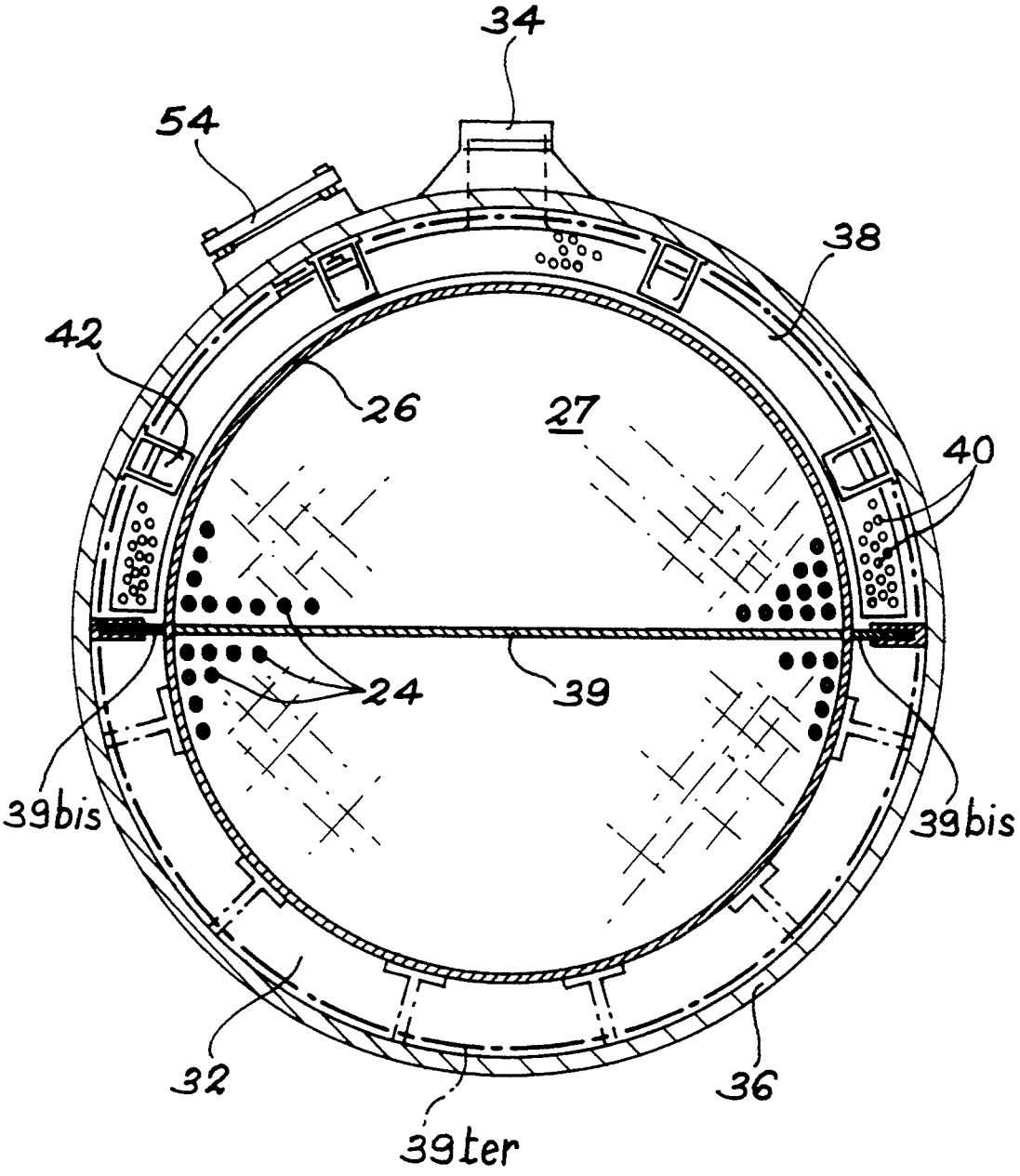
FIG. 2 is a larger scale cross-sectional view along line II—II of FIG. 1.

However, when the steam generator is of the economizer or preheating type illustrated in FIGS. 1 and 2, i.e., when a vertical partition plate 39 enters the tube bundle from the tube plate 12 between the hot and cold branches of the tubes 24 physically separating said two branches and when a separating plate 39 is physically separates the annular space 32 into a hot side annular space and a cold side annular space, the secondary water supply can take place either totally from the side of the cold branches, which means that the collector 38 is semitoroidal (FIG. 2), or mainly from the side of the cold branches and, to a limited extent, the side of the hot branches, which as in the case of the evaporator tube-type steam generator leads to the use of a toroidal supply collector 38 (FIG. 1). In both cases, a metal protection circular envelope 39 outer of the outer envelope 10 can be installed (FIGS. 2 and 4), in order to protect the latter against thermal shocks due to the impact of supply or feed water jets. This protection need be installed only on the side where the semitorus (economizer or preheater) is located, or in a complete manner (boiler) between the supply collector 38 and the outer envelope 10.

Figure 3:
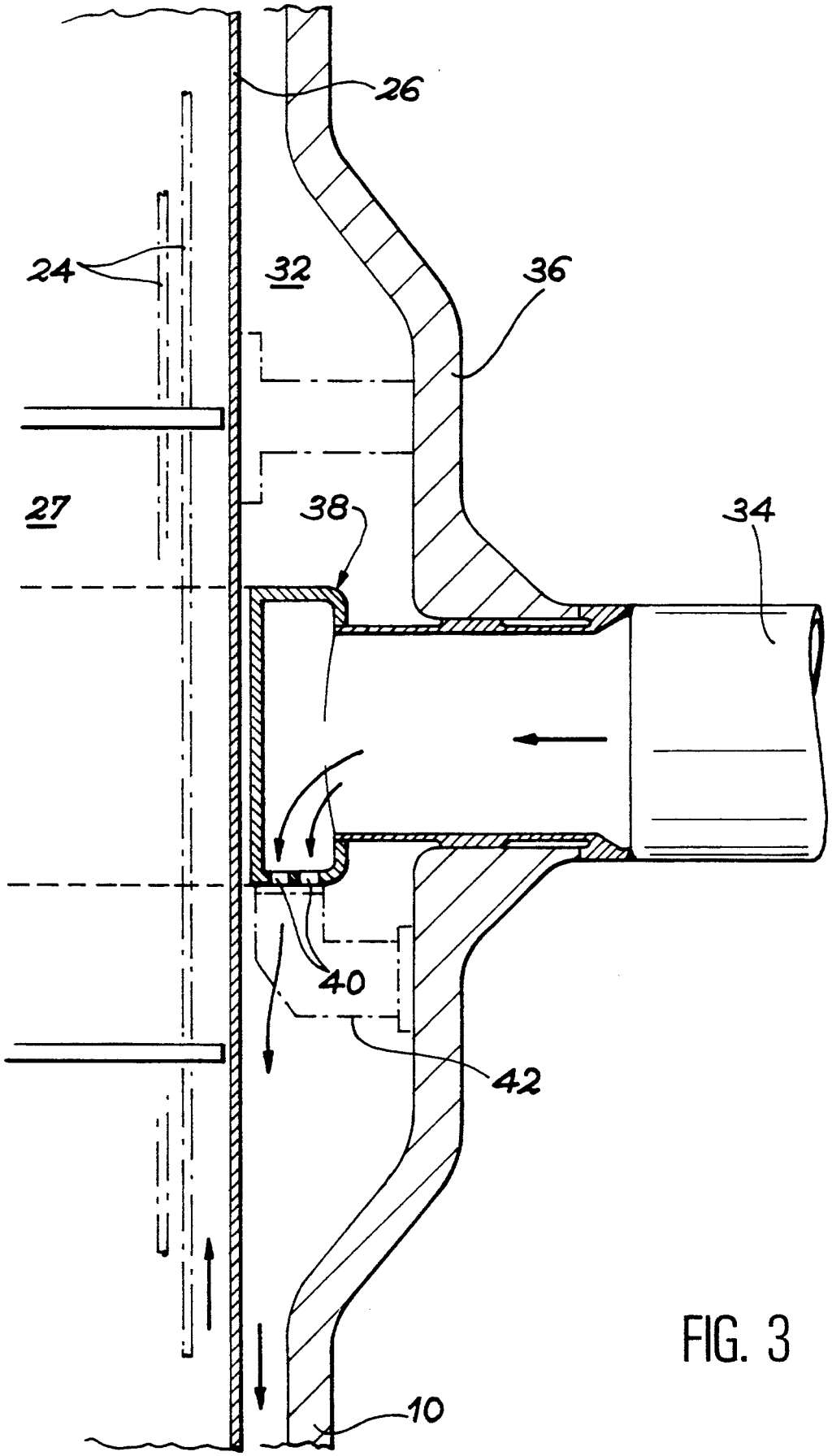
FIG. 3 is a larger scale vertical sectional view of that part of the steam generator in which is installed the secondary water supply collector according to the invention.
Figure 4:
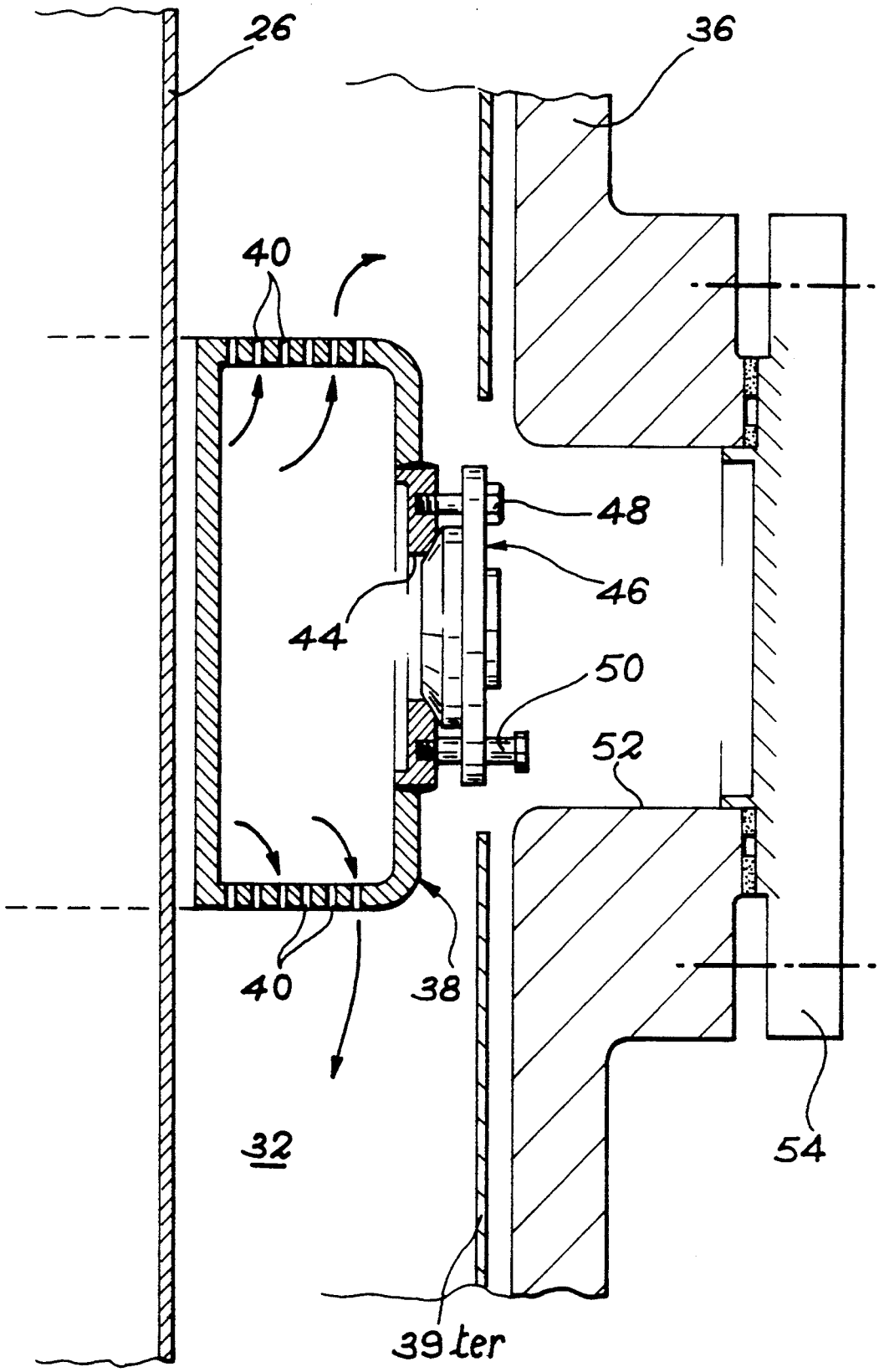
FIG. 4 is a similar view to FIG. 3 and shows an access orifice through which it is possible to perform an intervention within the supply collector.

In the embodiment illustrated in FIGS. 2 to 4, the supply collector 38 has a substantially rectangular cross-section, with vertically orientated large sides and horizontally oriented small sides. This shape has the advantage of limiting the radial overall dimensions of the collector, for a given maximum cross-section, which reduces the diameter increase of the part 36 of the outer envelope 10. It would also, however, be possible for the supply collector 38 to have a circular, square or other shape.

The secondary water admitted into the supply collector 38 enters the steam generator annular space 32 through holes 40 (FIGS. 3 and 4) arranged so as to orient the secondary water flowing into the space 32 in with a substantially vertical mean direction. These holes 40 are advantageously oriented downwards, as illustrated in FIG. 3, i.e., they are formed on the lower side of the rectangle formed in cross-section by the collector 38 in the represented embodiment.

As is illustrated in a variant in FIG. 4, the holes 40 many also be formed in the collector 38, so as to permit a secondary water flow simultaneously towards the top and bottom in the annular space 32. In the embodiment shown, in which the collector 38 has a rectangular cross-section, this means that the holes 40 are formed in the small horizontal sides of the rectangle formed in cross-section by the collector. In certain cases, the holes 40 may be formed in the collector so as to permit only upward flow of the secondary water, into the space 32.

When the collector 38 has a cross-section other than a rectangular cross-section, the holes 40 are also formed in the lower and/or upper generatrixes of the collector, so as to permit a substantially vertical mean flow of the secondary water, as stated hereinbefore.

The cross-sectional shape of the holes 40 may be circular, square, rectangular, etc., and their maximum size is smaller than the minimum distance separating the tubes 24 of the bundle. This characteristic enables the collector 38 to form a filter trap, in which are stopped the migrating bodies present in the secondary circuit and which could become jammed between the tubes 24 of the bundle. This prevents the migrating bodies from damaging or deteriorating the bundle tubes 24 of the steam generator. Depending on their cross-section, the holes 40 can be produced by broaching or some other method.

Moreover, the number of holes 40 formed in the collector 38, as well as their position and orientation, are selected so as to obtain a relatively low flow rate of the secondary water leaving the collector 38 and so that the individual jets passing out of each of the holes intercept one another. This means that if the mean direction of the flow from the collector 38 is substantially vertical, the holes 40, considered individually, can be inclined by different angles with respect to the vertical. These features make it possible to facilitate the mixing and homogenization of the secondary water leaving the collector 38 and the recirculation water leaving the separators 28, which drops again into the annular space 32.

Holes 40 may also have different cross-sections, in order to permit a controlled distribution of the secondary water flow entering the space 27 around the bottom part of the tubes 24. Thus, in the case where the steam generator is of the economizer or preheating type and use is made of a toroidal collector 38, the cross-section and/or density of the holes 40 formed in the collector on the side of the hot branches of the tubes can be substantially smaller than the cross-section and/or density of the holes formed on the side of the cold branches of the tubes.

A comparable result can also be obtained, e.g. by providing holes 40 issuing towards the bottom only in that part of the collector located on the side of the hot branches of the tubes, whereas the part of the collector located on the side of the cold branches of the tubes has holes 40 issuing both upwards and downwards.

As shown schematically in FIGS. 2 and 3, the collector 38 is supported by brackets 42 holding the collector at the top or bottom and circumferentially distributed around the vertical axis of the steam generator, so as to be positioned substantially equidistantly of one another. More specifically, each of the brackets 42 is fixed to the advantageously larger diameter part 36 of the outer envelope 10 below the collector 38, so that the latter rests on the brackets 42. The brackets can also be positioned above the collector 38 and support the latter.

As illustrated in FIG. 4, the collector 38 has, on its face turned radially towards the outside of the steam generator, at least one access opening 44 normally tightly closed by a plug 46. The closure can be sealed by the cooperation of complementary frusto-conical surfaces formed respectively in the access opening 44 and on the plug 46.

Preferably, the opening/closing mechanism by which the plug 46 is fixed to the supply collector 38 is designed so as to make the plug 46 captive. To this end and as illustrated in FIG. 3, the plug 46 can be provided with several captive screws 48, which can be screwed into the collector 38 and it remains connected to the latter by a rod 50 fixed to the collector 38 below the opening 44 and on which the plug 46 can slide and rotate at random. Thus, when the captive screws 48 are unscrewed, the plug 46 pivots downwards around the rod 50, so as to free the opening 44.

To enable the operator to have access to the plug 46 sealing the access opening 44 of the admission collector 38, the access opening 44 of the latter is positioned facing an inspection opening 52 formed in the larger diameter part 36 of the outer envelope 10. This inspection opening 52 has a diameter larger than that of the plug 46 and is normally tightly closed by a hatch 54 accessible from the outside of the steam generator.

The characteristics described hereinbefore in connection with FIG. 4 enable an operator to have access to the interior of the 10 admission collector 38, in order to inspect the latter and remove any migrating bodies which might have become trapped there. The opening of the hatch 54 also makes it possible to inspect the annular space 32 located immediately above and below the admission collector 38.

A variant of the admission collector 38 will now be described, with reference to FIG. 5.

As in the embodiment previously described with reference to FIGS. 2 to 4, the admission collector 38 has a substantially rectangular cross-section, with vertically oriented large sides and horizontally oriented small sides. However, in FIG. 5, the inner wall of the collector 38, forming in cross-section one of the large sides of the rectangle, is directly formed by the inner envelope 26 of the steam generator. The upper and lower walls of the collector 38, forming in cross-section the small sides of the rectangle, are directly welded to the envelope 26, so that the latter supports the collector 38.

Figure 5:
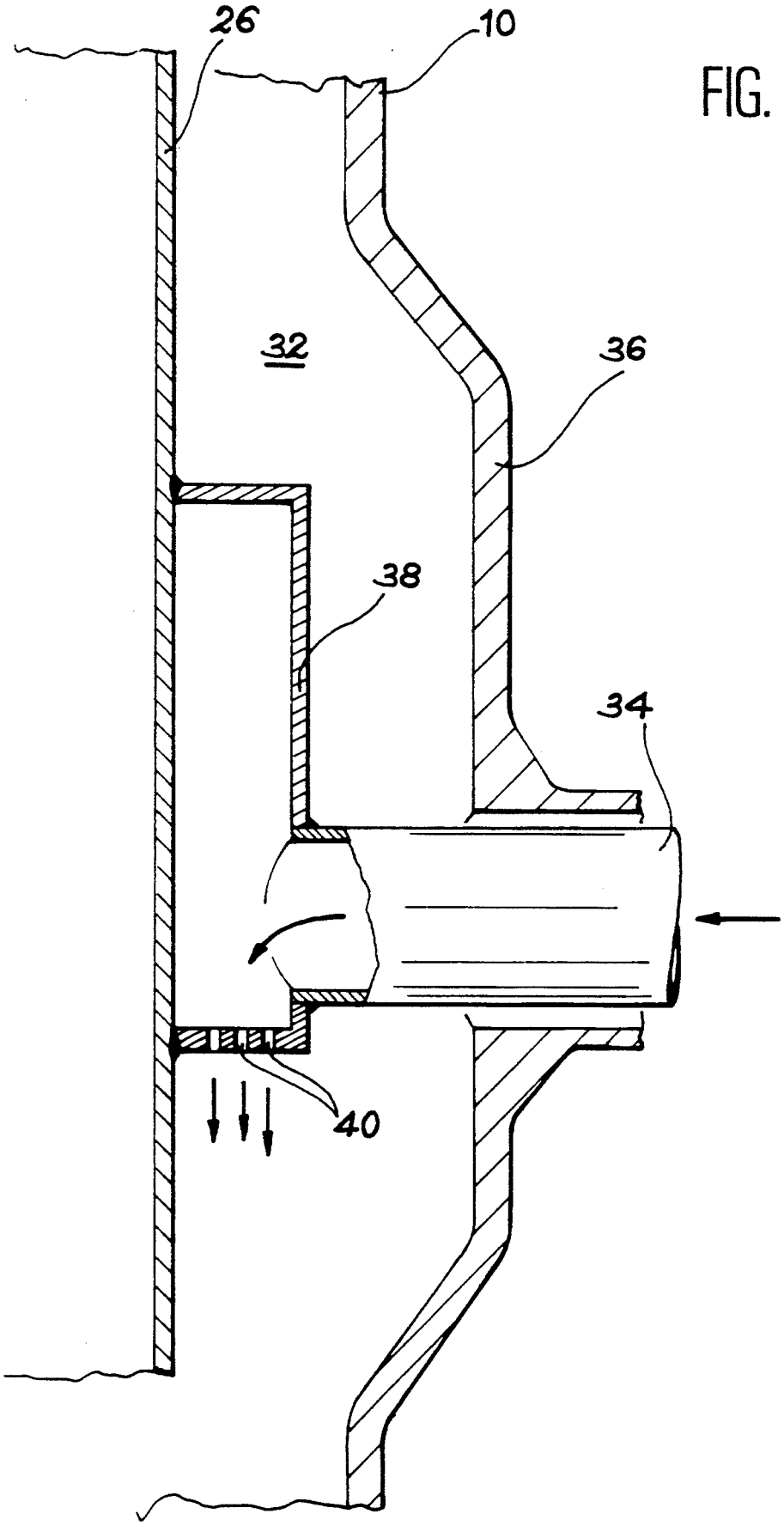
FIG. 5 a view similar to FIGS. 1, 3 and 4, showing a variant of the invention.

In other respects, the collector 38 shown in FIG. 5 is identical to the collector described with reference to FIGS. 2 to 4.

The steam generator according to the invention can also have a standby supply collector. Depending on the particular case, this standby supply collector can be located in the same bottom part of the annular recirculation space 32 as the main supply collector or in the upper part of the steam generator, above the annular space. In the first case, the standby supply collector **56*a* has holes 58*b* ensuring a substantially vertical mean flow of the secondary water into the annular space. In both cases, the holes 58*a*, 58*b* formed in the standby supply collector 56*a*, 56*b*** have a maximum size less than the maximum distance separating the tubes of the bundle.

We claim:

1. Steam generator comprising a vertically axed outer envelope, a horizontal tube plate tightly fixed to the interior of the outer envelope, a bundle of inverted U-tubes, each having two ends fixed to the tube plate and issuing below the tube plate, respectively into an admission collector and into a discharge collector for the primary fluid, an inner envelope covering the tube bundle and having a lower edge spaced from the tube plate and forming with the outer envelope an annular recirculation space, secondary water supply means incorporating a main supply collector and secondary steam extraction means through upper parts of the inner and outer envelopes, wherein the main supply collector is disposed in the bottom part of the annular recirculation space and has holes ensuring a substantially vertical mean flow of the secondary water into said annular space, said holes having a maximum size smaller than a minimum distance separating the tubes of the bundle.

2. Steam generator according to claim 1, wherein the main supply collector is partly defined by the inner envelope.

3. Steam generator according to claim 1, wherein the supply collector has downwardly issuing holes.

4. Steam generator according to claim 1, wherein the supply collector has upwardly issuing holes.

5. Steam generator to claim 1, wherein the supply collector has holes issuing downwards and holes issuing upwards.

6. Steam generator according to claim 1, wherein the supply collector is placed level with a larger diameter part of the outer envelope.

7. Steam generator according to claim 1, wherein the supply collector has at least one access opening, normally sealed by a plug, positioned facing an inspection opening formed in the outer envelope and normally closed by a hatch.

8. Steam generator according to claim 7, wherein the plug is connected to the supply collector by an opening/closing mechanism, which makes it captive.

9. Steam generator according to claim 1 wherein the supply collector is toroidal.

10. Steam generator according to claim 1, comprising the supply collector is semitoroidal.

11. Steam generator according to claim 1, wherein the supply collector has a substantially rectangular cross-section.

12. Steam generator according to claim 9, comprising a circular envelope in the annular space between the supply collector and the outer envelope.

13. Steam generator according to claim 10, comprising a semicircular envelope is placed in the annular space between the supply collector and the outer envelope.

14. Steam generator according to claim 1, further comprising a standby supply collector placed in the bottom part of the annular recirculation space and having holes ensuring a substantially vertical mean flow of the secondary water into said annular space.

15. Steam generator according to claim 1, further comprising a standby supply collector placed in the upper part of said steam generator above the annular recirculation space.

16. Steam generator according to claim 14, wherein said standby supply collector has holes having a maximum size smarter than the minimum distance separating the tubes of the bundle.

* * * * *

UNITED STATES PATENT AND TRADEMARK OFFICE

CERTIFICATE OF CORRECTION

PATENT NO. : 5,347,959

DATED : September 20, 1994

INVENTOR(S) : Slama et al

It is certified that error appears in the above-identified patent and that said Letters Patent is hereby corrected as shown below:

In column 7, claim 13, line 2, delete "is placed".

In column 8, claim 16, line 3, change "smarter" to --smaller--.

Signed and Sealed this

Eighteenth Day of April, 1995

Bruce Lehman

*Attest:*

BRUCE LEHMAN

*Commissioner of Patents and Trademarks*

*Attesting Officer*